United States Patent [19]

Fisher et al.

[11] 4,356,887

[45] Nov. 2, 1982

[54] ROTATABLE PLATFORM ASSEMBLY

[75] Inventors: Robert E. Fisher, Berkeley; Gerhard J. Weiner, Walnut Creek, both of Calif.

[73] Assignee: Up-Right, Inc., Berkeley, Calif.

[21] Appl. No.: 221,031

[22] Filed: Dec. 29, 1980

[51] Int. Cl.[3] ..... E04G 1/22

[52] U.S. Cl. ..... 182/63; 182/148; 187/18

[58] Field of Search ..... 182/62.5, 63, 148, 141, 182/69; 187/18

[56] References Cited

U.S. PATENT DOCUMENTS

| | | | |
|---|---|---|---|
| 596,676 | 1/1898 | Ford | 182/141 |
| 803,717 | 11/1905 | Scharz | 182/63 |
| 1,091,419 | 3/1914 | Yandell | 182/141 |
| 1,092,096 | 3/1914 | Donigan | 182/62.5 |
| 1,638,611 | 8/1927 | Baldwin | 182/141 |
| 2,647,022 | 7/1953 | Smid | 182/63 |
| 2,888,299 | 5/1959 | Balogh | 182/148 |
| 3,095,945 | 7/1963 | Mitchell | 182/148 |
| 3,509,965 | 5/1970 | Mitchell | 182/62.5 |
| 3,709,322 | 1/1973 | Mitchell | 182/148 |

*Primary Examiner*—Reinaldo P. Machado
*Attorney, Agent, or Firm*—Phillips, Moore, Lempio & Finley

[57] ABSTRACT

A rotatable platform assembly having upper and lower frames coupled together for rotation of the upper frame relative to the lower frame and about a first and fixed vertical axis. A large diameter ring, having its center at the first vertical axis, is mounted on the lower frame and has a cylindrical vertical outer surface and an annular horizontal track surface. The upper frame has a plurality of rollers in rolling engagement with the track and a chain sprocket mounted thereon and rotatable about a second vertical axis. A standard roller chain is trained around the ring and chain sprocket and the ring is provided with fixed chain-engaging pins and adjustable pad members engageable with the chain to take up chain slack between pins. A manually-operable, lockable and impact-releasable drive means is provided in the upper frame for rotation of the chain sprocket, so that the upper frame rotates about the first vertical axis with the rotating chain sprocket orbiting around such axis.

15 Claims, 8 Drawing Figures

ROTATABLE PLATFORM ASSEMBLY

DESCRIPTION

1. Technical Field

This invention relates to mobile scaffold units and in particular, to a mobile scaffold unit having a work platform which can be rotated in a horizontal plane relative to the base of the unit.

2. Background of the Invention

Mobile scaffold units presently exist having an elongated and elevatable work platform which can be rotated about a fixed vertical axis at one end of the platform to a desired position. One problem which exists with present units is that the work platform has fixed limits of rotation. Thus, the platform may be rotated in one direction to reach a desired position. If the desired position is at, or close to, the limit of rotation in that direction, and if the workman then wants to rotate the platform a little further in that direction to reach a new point, he will have to rotate the platform in the other direction and through almost a full revolution to reach the desired point. Another problem with present units is that undesirably high horizontal forces are imposed on the rotational mounting of the work platform because of the difficulty of counterbalancing the weight of the workman who may be anywhere from one end of the platform to the other.

One of the objects of the present invention is to provide a work platform assembly which can rotate in either direction, from any position, with no fixed limits of rotation.

Another object of the present invention is to provide a rotatable deck platform assembly which can be easily counterbalanced a minimum of so that horizontal force is applied to the rotational mounting of the deck platform regardless of the position of the workman on the platform.

Still another object of the present invention is to provide a chain drive system for a rotatable deck platform wherein a standard roller chain is used and wherein a large sprocket is provided having an inexpensive adjustable diameter construction.

Yet another object of the invention is to provide a chain drive system for a rotatable deck platform wherein the platform can be locked against rotation when the workman is exerting normal work forces and which will declutch to allow rotation of the platform in the event a substantial sidewise force is applied to the platform.

A further object of the present invention is to provide a rotatable deck platform for a mobile scaffold unit wherein a workman on the rotatable deck may easily steer the unit regardless of the rotative position of the deck platform.

SUMMARY OF THE INVENTION

In one aspect of the invention, a rotatable platform assembly is provided having first and second horizontal frames, one above the other, means coupling the frames together for rotation of the upper frame relative to the lower frame about a fixed vertical axis, a ring member mounted on the first frame coaxial with the fixed vertical axis of rotation and having an outer cylindrical surface and an annular horizontal track surface, a plurality of rollers mounted on the second frame and in rolling engagement with the track surface, a chain sprocket mounted in the second frame for rotation about a vertical axis, an endless roller chain trained around the ring member and chain sprocket, means for holding the chain against lengthwise movement relative to the ring member and drive means for rotating the chain sprocket about its axis.

In another aspect of the invention, the ring member has a plurality of pins spaced around the ring to engage the roller chain and a plurality of pad members spaced around the ring member and in between the pins, the pad members having pad heads spaced outwardly from the ring member to engage the roller chain and take up the slack in such chain between adjacent pins.

It is a further aspect of the invention that a control panel is provided for a workman on the upper frame, the control panel remaining in fixed orientation with the lower frame regardless of the rotated position of the upper frame relative to the lower frame.

A still further aspect of the invention is that the upper frame is held at a rotated position relative to the lower frame with sufficient force as to resist normal torque exerted during work but is released for rotation if the torque on the upper frame exceeds a predetermined magnitude.

Other aspects, objects and advantages of the invention will become apparent from the following detailed description of the invention when considered in conjunction with the accompanying drawings.

DESCRIPTION OF THE PREFERRED EMBODIMENT

Figure 1:
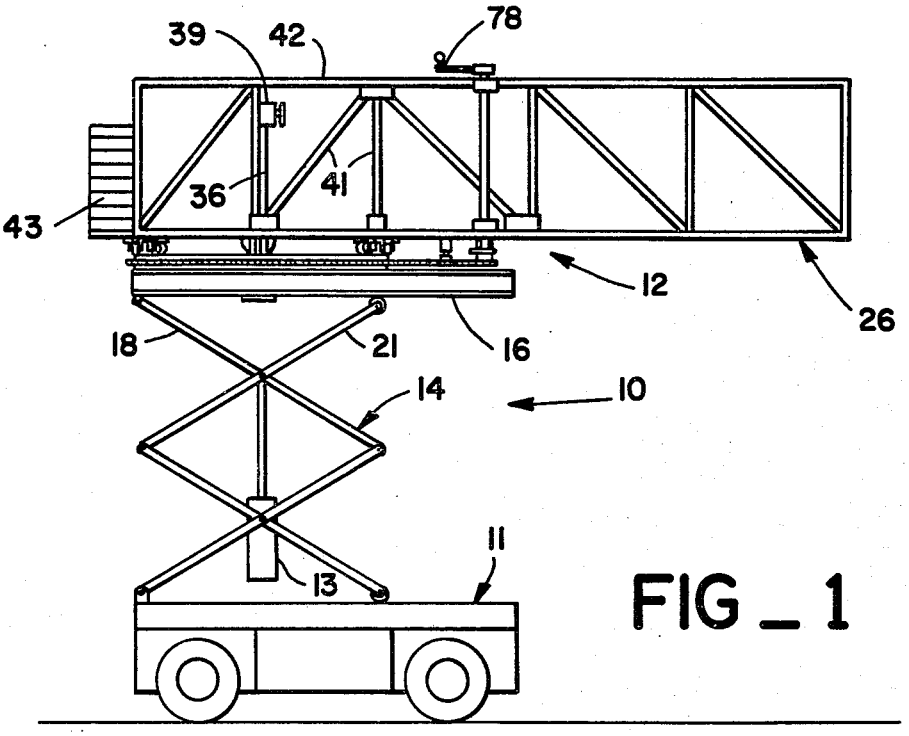
FIG. 1 is a side elevational view of a mobile scaffold unit utilizing the rotatable platform assembly of the present invention.

Referring now to the drawings, FIG. 1 illustrates a mobile scaffold unit 10 having a wheeled base 11 and a rotatable platform assembly 12 which may be elevated or lowered by the action of hydraulic ram 13 on the scissors linkage 14 interconnecting the base 11 and platform assembly 12.

Figure 2:
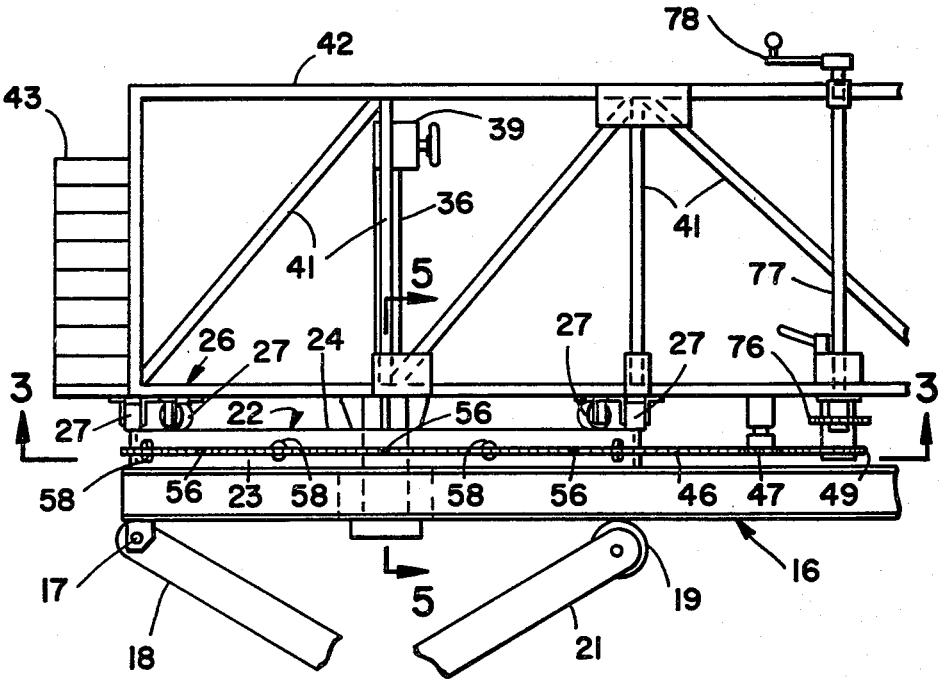
FIG. 2 is a side elevational view, on a larger scale, of a portion of the rotatable platform of FIG. 1.

As more particularly shown in FIG. 2, the rotatable platform assembly 12 includes a horizontal and generally rectangular lower frame 16, having one side thereof pivotally connected at 17 to the upper end of scissors linkage arm 18 and supported on roller 19 carried by the upper end of scissors linkage arm 21. A second parallel scissors linkage (not shown) also extends between the base 11 and the other side of the lower frame 16.

A ring member 22 is fixed to and extends upwardly from the lower frame 16, ring 22 having a cylindrical vertical outer surface 23 and an annular horizontal track surface 24. For support purposes, the diameter of ring 22 is preferably about the same as the width of the lower frame 12.

Figure 3:
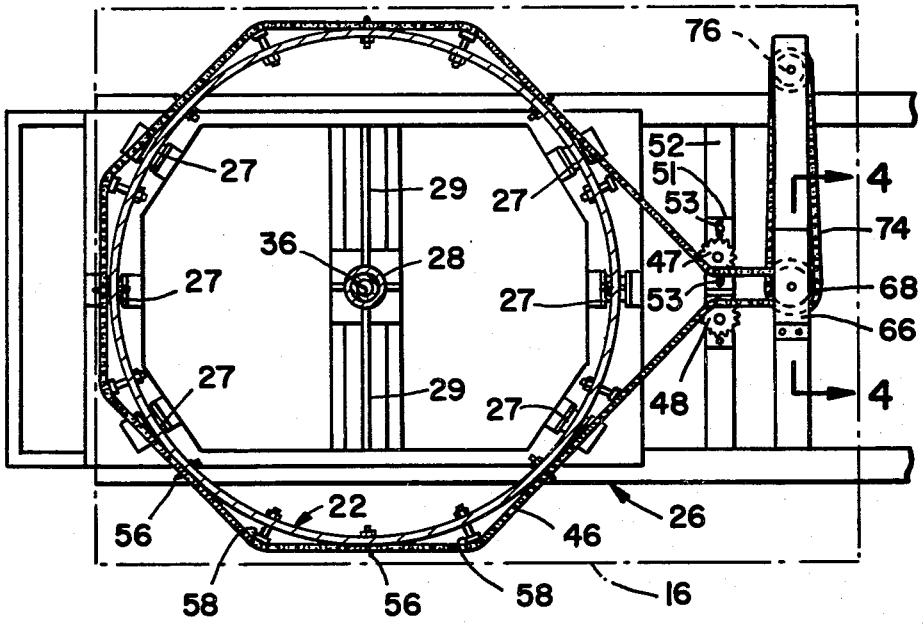
FIG. 3 is a sectional view, looking up, and taken on line 3—3 of FIG. 2.

The platform assembly 12 also includes a generally rectangular and horizontal upper frame 26 which is spaced above lower frame 16. The upper frame 26 is narrower and longer than lower frame 16 and has an upper flat surface which provides and serves as an elevatable work platform for the workman using the unit. The upper frame 26 has a plurality of rollers 27 mounted on its undersurface and in rolling engagement with the track surface 24 of ring member 22. As seen in FIG. 3, six rollers 27 are used, with two rollers on each side of the upper frame 26 and two rollers centrally of the upper frame 26, for maximum stability.

Figure 5:
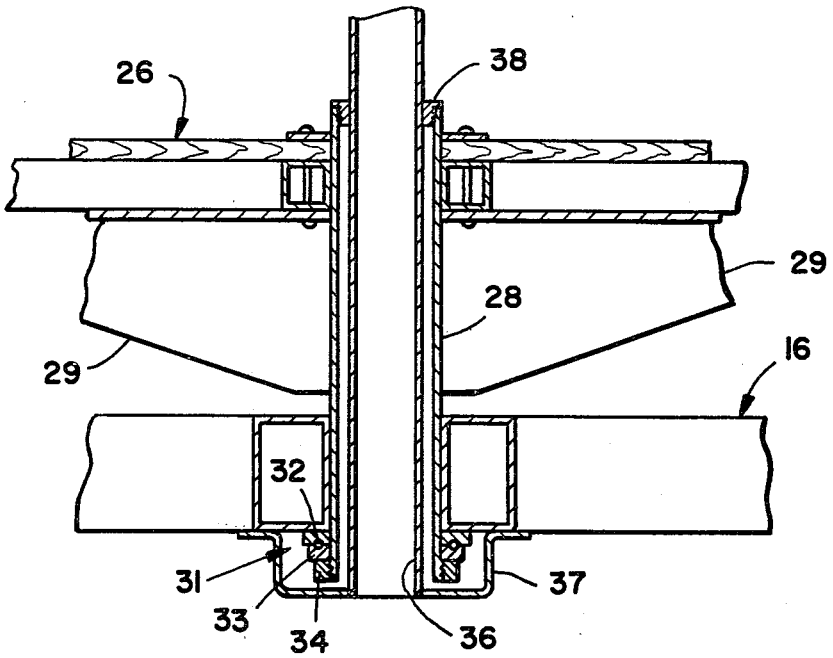
FIG. 5 is an elevational sectional view, taken on line 5—5 of FIG. 2.

As best seen in FIG. 5, the upper and lower frames 26 and 16 are secured together by an outer vertical tubular post 28 fixed to the upper frame 26, as by stiffening gussets 29, and extending downwardly through the lower frame 16. Thrust bearing 31, having an upper race portion 32 fixed to the lower frame 16 and an upper race portion 33 fixed to post 26 by nut 34, holds the upper frame 26 against upward movement relative to the lower frame 16 while permitting the lower frame 26 to rotate relative to the lower frame 16 and about the vertical axis of post 26. An inner vertical tubular post 36 fixed at its lower end to the lower frame 16, by bracket 37, extends upwardly through the outer post 28 and a nylon bearing 38 centers the upper end of the outer post 28 on the inner post 36 and enables the outer post 28 to rotate relative to the fixed inner post 36. Posts 28 and 36 are each coaxial with ring member 22 and are located at a substantial distance from the lengthwise center of the upper frame 26. As shown in FIGS. 1 and 2, a control panel 39 is mounted on the upper end of the fixed inner post 36.

The upper frame 26 has conventional truss members 41 and guard rails 42 therearound, and a counterweight 43 is mounted on the end of the upper frame 26 closest to posts 28 and 36 to counterbalance the weight of a workman who moves to the other end of the upper frame.

As best seen in FIGS. 2 and 3, the upper frame 26 is rotated relative to the lower frame 16 and about the vertical axis of posts 28 and 36, by means of a standard roller chain 46 trained around the vertical cylindrical surface 23 of ring member 22, around idler sprockets 47 and 48 and chain sprocket 49, sprockets 47,48, and 49 all being mounted on the upper frame 26 for rotation about vertical axes. The bracket 51 which mounts idler sprocket 47 to cross beam 52 of the upper frame 26 is provided with elongated slots 53 so that the position of sprocket 47 can be adjusted transversely of the upper frame to provide for proper tightening of chain 46.

Figure 6:
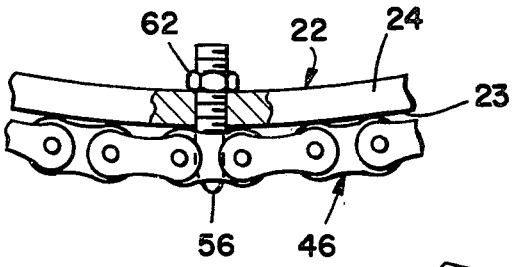
FIGS. 6 and 7 are enlarged details, in plan and in elevation, respectively, of the pin engagement between the drive chain and frame ring.
Figure 7:
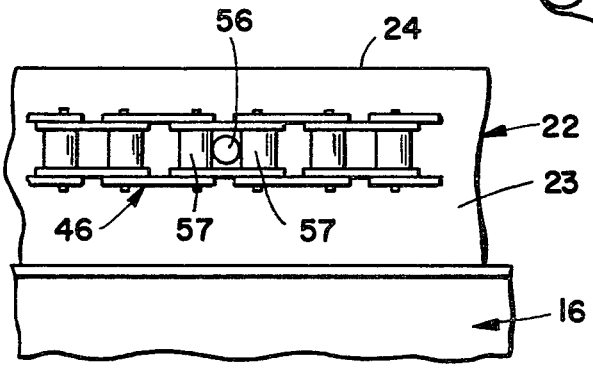

A plurality of sprocket pin members 56 are fixed to ring member 22 and, as seen in enlarged scale in FIGS. 6 and 7, project outwardly from the vertical cylindrical surface 23 of ring member 22 and between adjacent rollers 57 of roller chain 46. Pin members 56 are spaced apart around ring member 22 at substantially equal distances, and serve to engage the roller chain 46 at spaced apart points lengthwise of the chain and to hold the chain against lengthwise movement relative to the ring member.

Figure 8:
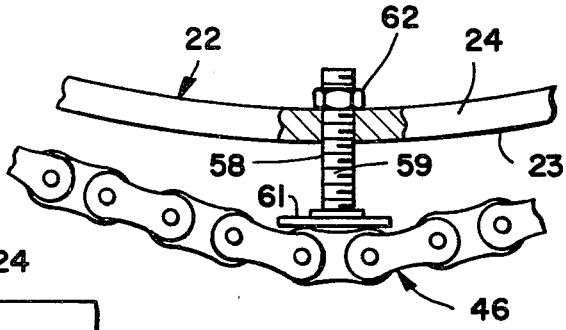
FIG. 8 is an enlarged detail, in plan, of one of the adjustment pads carried by the frame ring.

At least one adjustable pad member 58 is mounted on ring member 22 between each two adjacent sprocket pin members 56. As seen in enlarged detail in FIG. 8, each pad member 58 has a shank 59 threaded through ring member 22 to enable the pad head 61 to be moved towards or away from the ring member. In the initial fabrication of the rotatable deck assembly, the pad members 58 will be screwed into the ring member 22 and the roller chain 46 will be loosely trained around the ring member and positioned on the fixed sprocket pins 56. The pad member 58 will then be screwed outwardly from the ring member so that the pad heads 61 abut the chain 46 and take up the slack of the chain between adjacent sets of sprocket pins 56. When so adjusted, the pad members 68 are locked in position relative to ring member 22 by jam nuts 62.

Figure 4:
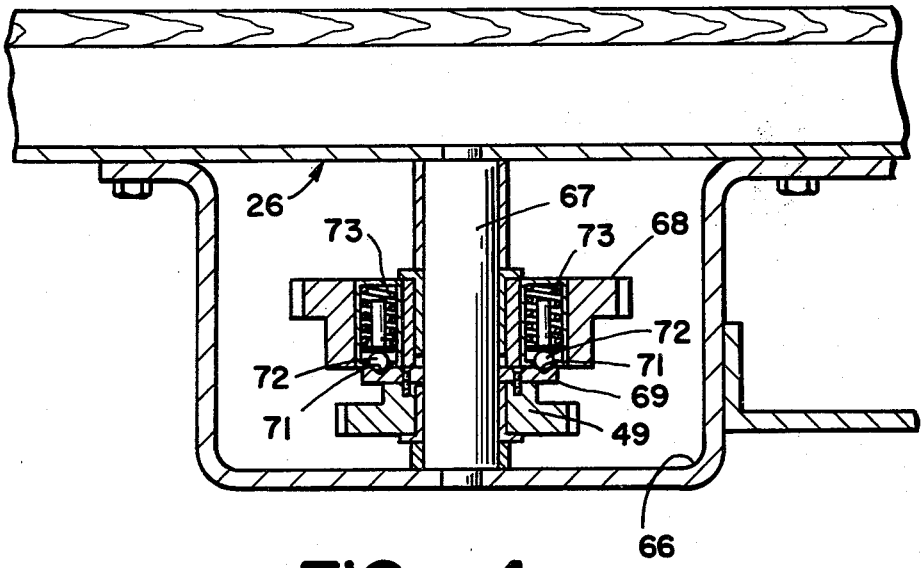
FIG. 4 is an elevational sectional view, taken on line 4—4 of FIG. 3.

As best seen in FIG. 4, bracket 66 supports vertical shaft 67 in fixed relation to the upper frame member 26, with chain sprocket 49 and drive sprocket 68 being mounted on shaft 67 for co-axial rotation. A detent plate 69, fixed to chain sprocket 49, has a plurality of detents 71 in the upper surface thereof into which balls 72, carried by drive sprocket 68, are pressed by springs 73. As is apparent, the balls 72 and detent 71 provide a clutch arrangement whereby rotation of drive sprocket 68 will drive chain sprocket 49 as long as the force applied to the drive sprocket is insufficient to cam the balls 72 upwardly out of the detents 71.

Returning to FIG. 3, a second drive chain 74 is trained around drive sprocket 68 and sprocket 76. As seen in FIG. 2, vertical shaft 77 is rotatably mounted on the upper frame 26, shaft 77 having sprocket 76 fixed thereto at its lower end and a manually-operable crank arm 78 fixed thereto at its upper end. Preferably, a releaseable locking device 81 is provided, such device functioning, for example, to release shaft 77 for rotation by crank 78 when the workman presses down on the foot-actuated lever 82 and to hold shaft 77 against rotation when lever 82 is released. Since a variety of locking devices exist which may be used for this purpose, and since the specific details thereof are not part of this invention, locking device 81 has only been shown generally.

OPERATION

In use, a workman on the rotatable deck platform assembly 12 will cause the mobile scaffold unit 10 to move t a desired work site, control panel 39 having suitable controls thereon for enabling the workman to apply forward or reverse power to the wheeled base 11, to steer the unit and to elevate or lower the platform assembly 12 relative to the base unit.

At the worksite, the workman will then cause the scissors linkage to extend and elevate the platform assembly to the desired height. If the workman wants to move the cantilevered end (i.e. the right end in FIG. 1) of the upper frame 26 closer to where he wants to work, he will turn crank 78 in the desired direction. The rotation of shaft 77 and sprocket 76 will cause drive sprocket 76 to rotate chain sprocket 49 relative to the upper frame 26. Rotation of the chain sprocket 49 will pull on chain 46, which is held on the fixed ring member 22, and will thus pull the upper frame 26 in the desired direction with the chain sprocket 49 orbiting around the axis of the ring member 22.

It is a particular advantage of the present chain drive system that there are no fixed limits to which the upper frame 26 may be rotated relative to the lower frame 16. Regardless of the direction of rotation, the upper frame may be continually rotated relative to the lower frame 16 through any number, a portion, or full revolution. As a consequence, regardless of the position of the upper frame 26, the workman may rotate it, in either direction as desired, to reach a new position.

It will often occur that the workman may wish to move the mobile unit 10 during work. It is an advantage of the present invention that the inner post 36 and control panel 39 are fixed to the lower frame 16 and do not rotate with the upper frame 26. As a consequence, the orientation of the control panel relative to the lower frame 16 and wheeled base 11 will remain the same, regardless of the position to which the upper frame 26 has been rotated, making it very easy for the workman on the upper frame to move the wheeled base 11 in a desired direction.

It may occur that in moving the unit 10, with the cantilevered end of the upper frame 26 extending outwardly on one side of the unit, and with shaft 77 and drive sprocket 68 locked against rotation, that the extending end of the upper frame 26 may accidentally run into a fixed object. If this occurs, a horizontal torque force will be imposed on the upper frame 27, urging chain sprocket 49 to rotate so that the upper frame 26 can rotatably yield in response to such force. When the horizontal torque force on the upper frame exceeds the magnitude predetermined by the force of springs 73, balls 72 in the locked drive sprocket 68 will cam out of detents 71 allowing chain sprocket 49 to rotate about its axis and the upper frame 26 to rotate about the axis of post 36. The forces of springs 73 on balls 72 should be set at a sufficiently high force so that chain sprocket 49 will not unclutch under normal torque forces on the upper frame as will occur when the workman is working on a fixed work object adjacent the platform, but not so high that undue forces will be exerted on the platform in the event of accidental engagement with a fixed object while the unit is moving.

The ring member 26 of the present invention serves a dual purpose, in that it functions both as a fixed sprocket wheel in the chain drive system and also as a track for the rollers 27 of the upper frame member 26.

In functioning as a roller track, the large diameter of the ring member 22 (whose diameter is preferably greater than the width of the upper frame 26) enables the weight of the upper frame member to be distributed over a large area, so that very little side thrust is exerted on the members rotatably coupling the upper and lower frame together. In particular, the large diameter of ring member 22 enables the counterweight 43 to be located at a substantial distance from the axis of rotation of the upper platform so that the center of gravity of the upper frame member will remain somewhere within ring member 22 regardless of the position of the workman on the platform.

In functioning as a sprocket, the ring member 22 and its pins 56 and adjustable pads 58 are quite advantageous, in that little concern need be given to making the diameter of the ring member of the exact dimension needed for the particular roller chain 46 to be used therewith, thereby decreasing the cost of construction. In effect, the adjustable pads 58 serve to provide an adjustable diameter sprocket so that the roller chain 46 will be supported; without slack, on ring member 26 with the chain distance between adjacent pins 56 being exactly equal to a multiple of the pitch between adjacent rollers of the chain.

We claim:

1. A rotatable platform assembly comprising:

first and second horizontal frames, one above the other, a vertical post extending between said frame and rotatably journaled in one of said frames for rotation of the upper of said frames in a horizontal plane relative to the lower of said frames and about the vertical axis of said post, a ring member fixed to said first frame, said ring member having a cylindrical vertical surface coaxial with said facing away from said post and an annular horizontal track surface coaxial with said post, a plurality of rollers mounted on said second frame and in rolling engagement with said track surface of said ring member, a chain sprocket mounted on said second frame for rotation about a vertical axis spaced outwardly from said ring member, a plurality of sprocket pin members on and spaced around and projecting outwardly from said cylindrical vertical surface of said ring member, an endless roller chain trained around said ring member and said chain sprocket and engaged by said sprocket pin members, drive means mounted on one of said frames for rotating said chain sprocket about its vertical axis.

2. A rotatable platform assembly as set forth in claim 1 wherein said drive means includes a manually-operable member for actuating said drive means and said manually-operable member is mounted on the upper of said frames.

3. A rotatable platform assembly as set forth in claim 1, wherein said first frame is below said second frame and said drive means is mounted on said second frame.

4. A rotatable platform assembly as set forth in claim 1, wherein said post is situated at a substantial distance from the lengthwise center of the upper of said frames.

5. A rotatable platform assembly as set forth in claim 4, wherein the lower of said frames is wider than the upper of said frames and wherein the diameter of said ring member is greater than the width of the upper of said frames.

6. A rotatable platform assembly as set forth in claim 1 wherein said post is fixed to the lower of said frames and extends upwardly through the upper of said frames.

7. A rotatable platform assembly as set forth in claim 6 and further including a control panel fixed to the upper end of said post.

8. A rotatable platform assembly as set forth in claim 7 and further including an outer tubular post fixed to the upper of said frames and surrounding said first mentioned post, and a vertical thrust bearing having a first portion fixed to the lower of said frames and a second portion below said first portion and fixed to said outer post.

9. A rotatable platform assembly as set forth in claim 1 and further including a plurality of pad members spaced around said ring member with at least one pad member being disposed between each two adjacent pin members, each pad member having a pad head abuttable with the roller chain trained around said ring member, and means for individually adjusting the outward spacing of each pad head from said cylindrical vertical surface of said ring member.

10. A rotatable platform assembly as set forth in claim 1 wherein said drive means includes means for holding said chain sprocket against rotation and for releasing such holding in response to the imposition of a horizontal torque force on the upper of said frames which is greater than a predetermined magnitude.

11. A rotatable platform assembly comprising:

upper and lower horizontal frames, said lower frame being wider than said upper frame and said upper frame being longer than said lower frame, a vertical post fixed to the lower of said frames and extending upwardly through the upper of said frames, said upper frame being journaled on said post for rotation in a horizontal plane about the axis of said post, said post being situated at a substantial distance from the lengthwise center of the upper of said frames, a ring member fixed to said lower frame, said ring member having an outer cylindrical surface coaxial with said post and an annular horizontal track surface coaxial with said post, said ring member having a diameter greater than the width of said upper frame, a plurality of rollers mounted on the upper frame and in rolling engagement with said track surface of said ring member, a chain sprocket mounted on said upper frame for rotation about a vertical axis, an endless roller chain trained around said outer cylindrical surface of said ring member and said chain sprocket, means engageable with said roller chain at spaced apart points lengthwise of said chain for holding said roller chain against lengthwise movement relative to said outer cylindrical surface of said ring member, manually controllable drive means mounted on said upper frame for rotating said chain sprocket about its axis.

12. A rotatable platform assembly as set forth in claim 11 and further including a control panel fixed to the upper end of said post.

13. A rotatable platform assembly as set forth in claim 11 wherein said drive means includes means for holding said chain sprocket against rotation and for releasing such holding in response to the imposition of a horizontal torque force on the upper of said frames which is greater than a predetermined magnitude.

14. In a chain drive system:

a ring member having a cylindrical outer surface, a plurality of pin members on and projecting outwardly from said cylindrical outer surface of said ring member, said pin members being spaced around said ring member, a plurality of pad members mounted on and spaced around said cylindrical outer surface of said ring member, with at least one pad member being disposed between each two adjacent pin members, each pad member having a pad head spaced outwardly from said cylindrical outer surfaces of said ring member, a chain sprocket spaced outwardly from said ring member and having an axis parallel to the axis of said ring member, an endless roller chain trained around said cylindrical outer surface of said ring member and said sprocket, said roller chain being engaged by a plurality of said pin members and in abutment with said pad heads of a plurality of said pad members.

15. In a chain drive system as set forth in claim 14 and further including means for individually adjusting the outward spacing of each pad head from said outer cylindrical surface of said ring member.

* * * * *